US010080267B2

(12) United States Patent
Lee et al.

(10) Patent No.: US 10,080,267 B2
(45) Date of Patent: Sep. 18, 2018

(54) ALTERNATING CURRENT-DRIVEN LIGHT EMITTING ELEMENT LIGHTING APPARATUS

(71) Applicant: Seoul Semiconductor Co., Ltd., Ansan-si (KR)

(72) Inventors: Hyung Jin Lee, Ansan-si (KR); Hyun Gu Kang, Ansan-si (KR); Sang Wook Han, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 102 days.

(21) Appl. No.: 15/317,737

(22) PCT Filed: Jun. 4, 2015

(86) PCT No.: PCT/KR2015/005606
§ 371 (c)(1),
(2) Date: Dec. 9, 2016

(87) PCT Pub. No.: WO2015/190746
PCT Pub. Date: Dec. 17, 2015

(65) Prior Publication Data

US 2018/0160497 A1 Jun. 7, 2018

(30) Foreign Application Priority Data

Jun. 12, 2014 (KR) ..... 10-2014-0071474

(51) Int. Cl.
*H05B 33/08* (2006.01)

(52) U.S. Cl.
CPC ..... *H05B 33/0851* (2013.01); *H05B 33/0824* (2013.01)

(58) Field of Classification Search
CPC ..... H05B 33/0851; H05B 33/0824
See application file for complete search history.

(56) References Cited

U.S. PATENT DOCUMENTS

2012/0091907 A1 4/2012 Setomoto et al.
2012/0098505 A1 4/2012 Irissou et al.
(Continued)

FOREIGN PATENT DOCUMENTS

CN 102186282 9/2011
CN 102474958 5/2012
(Continued)

OTHER PUBLICATIONS

International Search Report dated Aug. 31, 2015, in International Application No. PCT/KR2015/005606.
(Continued)

*Primary Examiner* — Jimmy Vu
*Assistant Examiner* — Pedro C Fernandez
(74) *Attorney, Agent, or Firm* — H.C. Park & Associates, PLC

(57) ABSTRACT

An AC-driven LED lighting apparatus includes: a triac dimmer to generate a modulated AC voltage by modulating a phase of AC power according to a selected level of dimming; a rectifying circuit to generate drive voltage by full-wave-rectifying the AC voltage having the phase modulated by the triac dimmer; a dimming level detector to detect a dimming level according to the drive voltage; a phase cut reference setting unit for setting a phase cut reference value; and a LED driving module for constant-current-controlling a plurality of LED groups by comparing the detected dimming level with the phase cut reference value, wherein the light emitting element driving module comprises a LED current blocking unit for blocking a drive current supplied to the plurality of LED groups when the dimming level is lower than the phase cut reference value.

9 Claims, 4 Drawing Sheets

(56) References Cited

U.S. PATENT DOCUMENTS

| | | | | |
|---|---|---|---|---|
| 2012/0206062 | A1 | 8/2012 | Riesebosch | |
| 2012/0319605 | A1* | 12/2012 | Choi | H05B 33/0815 315/201 |
| 2013/0049631 | A1* | 2/2013 | Riesebosch | H05B 37/02 315/291 |
| 2013/0241433 | A1 | 9/2013 | Ge et al. | |
| 2013/0293139 | A1* | 11/2013 | Sadwick | H05B 37/02 315/224 |

FOREIGN PATENT DOCUMENTS

| | | |
|---|---|---|
| EP | 2584866 | 4/2013 |
| KR | 10-2013-0091456 | 8/2013 |
| WO | 2009/120555 | 10/2009 |
| WO | 2013/183891 | 12/2013 |
| WO | 2014/073911 | 5/2014 |

OTHER PUBLICATIONS

Written Opinion dated Aug. 31, 2015, in International application No. PCT/KR2015/005606.

Notice of Allowance dated Jul. 10, 2017, in U.S. Appl. No. 15/438,737.

Extended European Search Report dated Dec. 14, 2017, in European Patent Application No. 15806981.5.

* cited by examiner

ALTERNATING CURRENT-DRIVEN LIGHT EMITTING ELEMENT LIGHTING APPARATUS

CROSS-REFERENCE TO RELATED APPLICATIONS

This application is the National Stage entry of International Application PCT/KR2015/005606, filed on Jun. 4, 2015, and claims priority from Korean Patent Application No. 10-2014-0071474, filed on Jun. 12, 2014, each of which is incorporated herein by reference for all purposes as if fully set forth herein.

BACKGROUND

Field

Exemplary embodiments of the present disclosure relate to a lighting apparatus using a dimmable alternating current-driven light emitting diode (LED), and more particularly, to an alternating current (AC)-driven LED lighting apparatus which allows dimming control through phase cut control and exhibits idealistic and stable variation of a dimming level over an entire interval of the dimming level using a triode for alternating current (TRIAC) dimmer. In addition, exemplary embodiments of the present disclosure relate to an AC-driven LED lighting apparatus which can improve compatibility of the TRIAC dimmer.

Discussion of the Background

Generally, a light emitting diode (LED) can be driven only by direct current (DC) power due to inherent characteristics thereof. Thus, a lighting apparatus employing such a conventional LED is limited in applicability and requires a separate circuit such as a switching mode power supply (SMPS) when used in domestic settings employing AC 220V power. As a result, the lighting apparatus has problems such as complicated circuit design and high manufacturing costs.

In order to solve such problems, various studies have focused on development of an AC-driven LED lighting apparatus which includes a plurality of light emitting cells connected to each other in series or in parallel and can be driven by AC power.

In order to solve the above problems in the related art, sequential driving of AC-driven LEDs has been suggested. In this sequential driving method, assuming that a lighting apparatus includes three groups of LEDs, under conditions that an input voltage increases over time, a first LED group starts to emit light in a first stage driving interval; a second LED group is connected in series to the first LED group and the first and second LED groups are turned on to emit light in a second stage driving interval in which a drive voltage is higher than the drive voltage in the first stage driving interval; and first to fourth LED groups are turned on to emit light in a third stage driving interval in which the drive voltage is higher than the drive voltage in the second stage driving interval. In addition, under conditions that the drive voltage decreases over time, first, the third LED group stops light emission in the second stage driving interval, the second LED group stops light emission in the first stage driving interval, and the first LED group finally stops light emission at a drive voltage lower than the drive voltage of the first stage driving interval such that an LED drive current approaches the input voltage.

On the other hand, LED dimming control refers to an operation of changing luminescent flux or illuminance (Lux) of an LED lighting apparatus, that is, brightness of a light source, according to voltage applied thereto, and a dimmable light source means a system configured to perform such illuminance control in the lighting apparatus. Such a dimmable system is provided to the LED lighting apparatus in order to reduce power consumption and enables efficient operation of the LED lighting apparatus. Particularly, heat generated during continuous light emission from LEDs causes deterioration in quality and efficiency of a lighting operation. Accordingly, in order to satisfy user demand while reducing power consumption, a dimming function is generally provided to the LED lighting apparatus. Among such LED lighting apparatuses having the dimming function, since a DC-driven LED lighting apparatus is driven by converting AC power into DC power through an SMPS, the DC-driven LED lighting apparatus allows relatively easy dimming and thus can be expected to have a certain degree of dimming control characteristics. However, since a typical AC-driven LED lighting apparatus as described above drives LEDs using only a rectified voltage obtained through rectification of AC voltage, the AC-driven LED lighting apparatus has difficulty realizing the dimming function and securing linearity in dimming control. Particularly, a sequential driving type AC-driven LED lighting apparatus has a problem in that drive voltage becomes unstable due to temporary increase or decrease in drive voltage by internal impedance of an AC power supply line and a dimmer as soon as LEDs are tuned on or turned off for the next operation when the number of LED groups turned on to emit light is changed depending upon the magnitude of the drive voltage (for example, upon change from fourth stage driving to third stage driving, upon change from third stage driving to second stage driving, and the like). That is, a typical AC-driven LED lighting apparatus having the dimming function suffers from irregular variation of luminescent flux in some dimming control intervals instead of enabling variation in the luminescent flux over an entire interval of the dimming level.

SUMMARY

Exemplary embodiments of the present disclosure are aimed at solving the aforementioned problems in the related art.

Exemplary embodiments of the present disclosure provide an AC-driven LED lighting apparatus which exhibits idealistic dimming characteristics over an entire interval of a dimming level.

Exemplary embodiments of the present disclosure provide an AC-driven LED lighting apparatus which exhibits good dimming characteristics in association with a TRIAC dimmer configured to perform dimming control through phase cut control.

Exemplary embodiments of the present disclosure provide an AC-driven LED lighting apparatus which prevents a flickering phenomenon upon sequential driving of LED groups.

Exemplary embodiments of the present disclosure provide an AC-driven LED lighting apparatus which prevents irregular dimming at a low dimming level.

In accordance with one exemplary embodiment of the present disclosure, an AC-driven LED lighting apparatus includes: a TRIAC dimmer generating a phase cut AC voltage through phase modulation of an AC voltage corresponding to a selected dimming level; a rectification unit generating a drive voltage through full-wave rectification of the phase cut AC voltage supplied from the TRIAC dimmer; a dimming level detection unit detecting a dimming level corresponding to the drive voltage;

a phase cut reference setting unit setting a phase cut reference value for comparison with the detected dimming level; and an LED driving module controlling a plurality of LED groups with constant current by comparing the detected dimming level with the phase cut reference value, wherein the LED driving module comprises an LED current blocking unit configured to block a drive current from being supplied to the plurality of LED groups when the dimming level is less than the phase cut reference value.

Accordingly, the AC-driven LED lighting apparatus according to the exemplary embodiment can prevent a flickering phenomenon by blocking a drive current from being supplied to all of a plurality of LED groups at a dimming level less than a preset phase cut reference value. Particularly, the AC-driven LED lighting apparatus can prevent a flickering phenomenon upon change from the maximum driving interval to other intervals, in which LED groups are turned off one by one (the fourth stage driving interval and the third stage driving interval with reference to the maximum fourth stage driving interval) in a plurality of LED groups configured to be sequentially driven.

Further, the AC-driven LED lighting apparatus according to the exemplary embodiment blocks the drive current from being supplied to all of the LED groups with reference to a preset phase cut reference value, thereby improving compatibility of a dimmer through improvement in dimming characteristics that vary depending upon the TRIAC dimmer.

The plurality of LED groups may be sequentially driven from a first stage driving interval to an $n^{th}$ stage driving interval.

The phase cut reference value may be set within the $n^{th}$ stage driving interval in which all of the LED groups are driven.

The LED current blocking unit may simultaneously block the drive current from being supplied to all of the LED groups.

The LED driving module may further include a comparator configured to compare the detected dimming level with the phase cut reference value.

The LED driving module may further include a drive current controller configured to control magnitude of the drive current of the plurality of LED groups corresponding to the dimming level.

The drive current controller may include a drive current register preset to be proportional to the dimming level.

The AC-driven LED lighting apparatus may further include a trigger current holding circuit connected between the TRIAC dimmer and the rectification unit and supplying a TRIAC trigger current to the AC power input or a rectified voltage output or acting as a dummy load circuit.

The trigger current holding circuit may be a bleeder circuit.

According to exemplary embodiments, the AC-driven LED lighting apparatus exhibits smooth dimming characteristics over an entire interval of a dimming level.

In addition, according to exemplary embodiments, the AC-driven LED lighting apparatus exhibits good dimming characteristics in association with a TRIAC dimmer configured to perform dimming control through phase cut control.

Further, according to exemplary embodiments, the AC-driven LED lighting apparatus prevents irregular flickering during sequential driving of LED groups.

Furthermore, according to exemplary embodiments, the AC-driven LED lighting apparatus can perform more efficient dimming control based on a phase cut drive voltage and a drive current for LEDs corresponding to a dimming level.

Furthermore, according to exemplary embodiments, the AC-driven LED lighting apparatus can block a drive current from being supplied to all of first to fourth LED groups at a dimming level less than a preset phase cut reference value, thereby preventing uneven brightness such as flickering. Particularly, the AC-driven LED lighting apparatus can prevent flickering and uneven dimming upon change from the maximum driving interval to other intervals, in which LED groups are turned off one by one (a fourth stage driving interval and a third stage driving interval with reference to the maximum fourth stage driving interval) in a plurality of LED groups configured to be sequentially driven.

Furthermore, according to exemplary embodiments, the AC-driven LED lighting apparatus blocks a drive current from being supplied to all of first to fourth LED groups with reference to a preset phase cut reference value, thereby improving compatibility of a dimmer through improvement in dimming characteristics that vary depending upon a TRIAC dimmer.

BRIEF DESCRIPTION OF THE DRAWINGS

The above and other aspects, features and advantages of the present invention will be more clearly understood from the following detailed description taken in conjunction with the accompanying drawings, in which.

DETAILED DESCRIPTION OF THE ILLUSTRATED EMBODIMENTS

Figure 1:
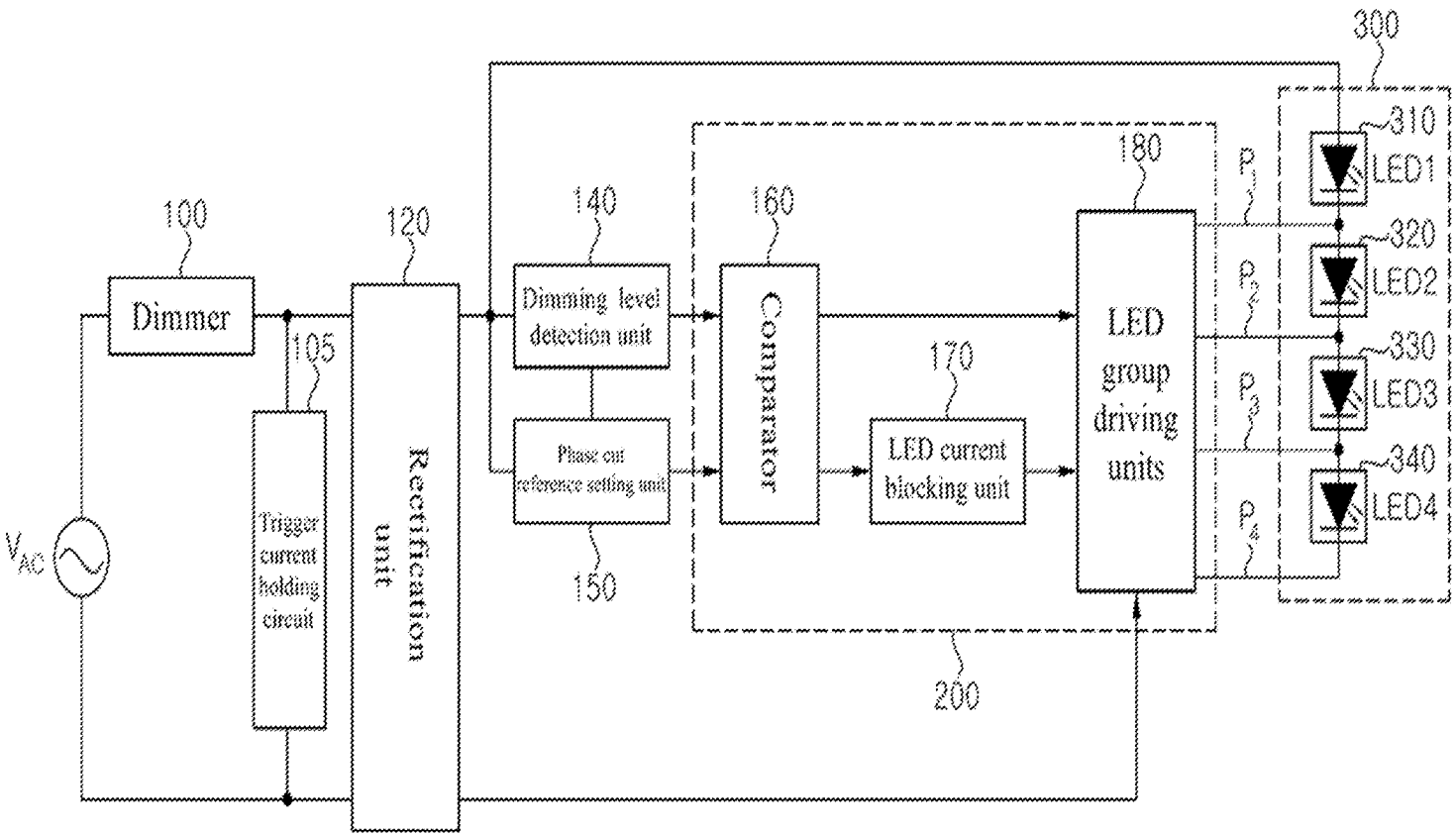
FIG. 1 is a block diagram of an AC-driven LED lighting apparatus according to one exemplary embodiment of the present disclosure.

Hereinafter, exemplary embodiments of the present disclosure will be described in detail with reference to the accompanying drawings. The following embodiments are provided by way of example so as to fully convey the spirit of the present disclosure to those skilled in the art to which the present disclosure pertains. Although various embodiments are disclosed herein, it should be understood that these embodiments are not intended to be exclusive. For example, individual structures, elements or features of a particular embodiment are not limited to that particular embodiment and can be applied to other embodiments without departing from the spirit and scope of the present disclosure. In addition, it should be understood that locations or arrangement of individual components in each of the embodiments can be changed without departing from the spirit and scope of the present invention. Therefore, the following embodiments are not to be construed as limiting the present disclosure, and the present disclosure should be limited only by the claims and equivalents thereof. Like components having the same or similar functions will be denoted by like reference numerals.

Hereinafter, exemplary embodiments of the present disclosure will be described in detail with reference to the accompanying drawings so as to be easily practiced by those skilled in the art.

Herein, the term "LED group" refers to a group of light emitting diodes (or light emitting cells) connected to one another in series/parallel/series-parallel to be operated as a single unit under control of a drive integrated circuit (IC) (that is, to be turned on/off at the same time).

In addition, the term "LED driving module" means a module configured to drive and control a light emitting diode after receiving AC voltage, and although the LED driving module is described with reference to exemplary embodiments in which driving of LEDs are controlled using a rectified voltage, it should be understood that other implementations are also possible and the LED driving module should be comprehensively and broadly interpreted.

Further, the term "first forward voltage level" means a critical voltage level capable of driving a first LED group, the term "second forward voltage level" means a critical voltage level capable of driving a first LED group and a second LED group connected to each other in series, and the term "third forward voltage level" means a critical voltage level capable of driving the first to third LED groups connected to each other in series. Namely, the term "$n^{th}$ forward voltage level" means a critical voltage level capable of driving the first to $n^{th}$ LED groups connected to each other in series. On the other hand, the forward voltage levels of LED groups may be the same or different depending upon the number/characteristics of LEDs constituting each of the LED groups.

Further, the term "sequential driving" means a method of sequentially driving a plurality of LED groups in an LED driving module, which drives light emitting diodes upon receiving an input voltage varying over time, such that the plural LED groups are sequentially turned on to emit light with increasing input voltage and are sequentially turned off with decreasing input voltage.

Further, the term "first stage driving interval" means a time interval in which only the first LED group is turned on to emit light, and the term "second stage driving interval" means a time interval in which only the first LED group and the second LED group are turned on to emit light. Thus, the term "$n^{th}$ stage driving interval" means a time interval in which all of the first to $n^{th}$ LED groups are turned on to emit light and a $(n+1)^{th}$ LED group or more LED groups do not emit light.

Figure 2:
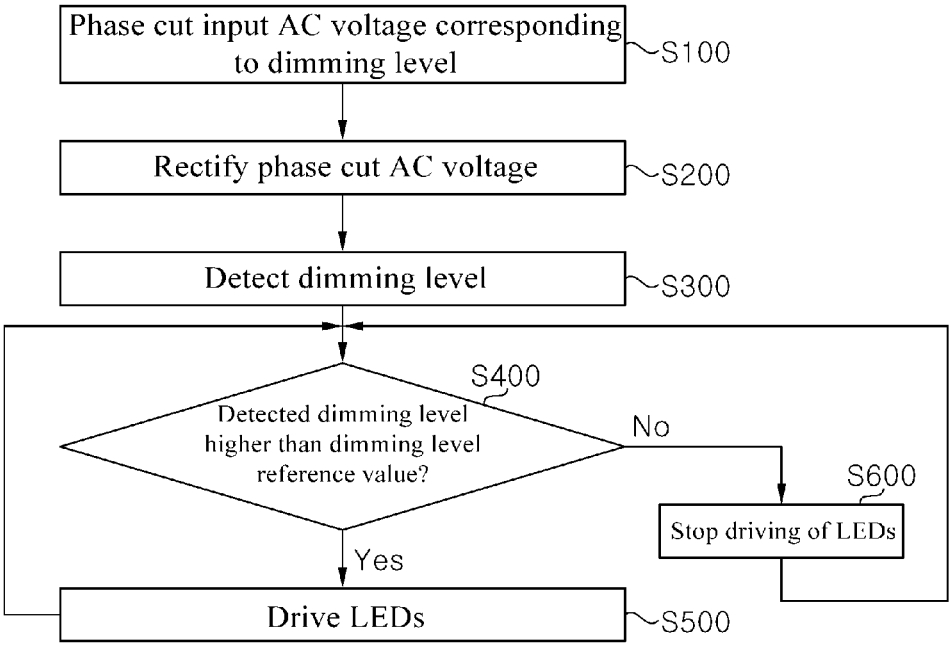
FIG. 2 is a flowchart of a driving method of the AC-driven LED lighting apparatus according to the exemplary embodiment of the present disclosure.

FIG. 1 is a block diagram of an AC-driven LED lighting apparatus according to one exemplary embodiment of the present disclosure and FIG. 2 a flowchart of a driving method of the AC-driven LED lighting apparatus according to the exemplary embodiment of the present disclosure.

Referring to FIG. 1, the AC-driven LED lighting apparatus according to one exemplary embodiment includes a TRIAC dimmer 100, a trigger current holding circuit 105, a rectification unit 120, a dimming level detection unit 140, a phase cut reference setting unit 150, an LED driving module 200, and an LED lighting unit 300.

The TRIAC dimmer 100 receives an AC voltage $V_{AC}$ input from an AC power source and generates a phase cut AC voltage obtained through phase modulation of the input AC voltage $V_{AC}$ corresponding to a dimming level selected by a user. The TRIAC dimmer 100 generates a phase-controlled AC voltage through phase modulation of the AC voltage $V_{AC}$ corresponding to the dimming level selected by a user. The TRIAC dimmer is well known in the art and thus a detailed description thereof will be omitted herein.

The trigger current holding circuit 105 is connected between the TRIAC dimmer 100 and the rectification unit 120, and supplies a TRIAC trigger current to an AC power input or a rectified voltage output, or acts as a dummy load circuit. For example, the trigger current holding circuit 105 may be a bleeder circuit composed of a bleeder capacitor and a bleeder resistor connected in series to the bleeder capacitor. Here, the trigger current holding circuit 105 is not limited to the bleeder circuit and may be one circuit selected from voltage stabilization circuits.

The rectification unit 120 generates a drive voltage through rectification of the phase cut AC voltage and outputs the drive voltage. The rectification unit 120 may be one of various rectification circuits well known in the art, such as a full-wave rectification circuit and a half-wave rectification circuit, without being limited thereto. For example, the rectification unit 120 may be a bridge full-wave rectification circuit composed of four diodes. The drive voltage generated by the rectification unit 120 is output to the dimming level detection unit 140, the phase cut reference setting unit 150, LED group driving modules 180, and the LED lighting unit 300.

The LED lighting unit 300 includes a plurality of LED groups. The plural LED groups are sequentially turned on or off. Although the LED lighting unit 300 is described as including first to fourth groups 310 to 340, it should be understood that other implementations are also possible and the number of LED groups can be changed in various ways. The first to fourth LED groups 310 to 340 may have different forward voltage levels, respectively. For example, when each of the first to fourth LED groups 310 to 340 includes a different number of LEDs, the first to fourth LED groups 310 to 340 have different forward voltage levels.

The dimming level detection unit 140 detects a current dimming level selected by a user based on the drive voltage supplied from the rectification unit 120 and outputs a dimming level signal corresponding to the detected dimming level to the LED driving module 200. More specifically, the dimming level detection unit 140 according to the exemplary embodiment can detect the dimming level by averaging drive voltage levels that change over time. Since the TRIAC dimmer 100 is configured to modulate a phase of the AC voltage $V_{AC}$ corresponding to the dimming level selected by a user, the dimming level detection unit 140 can detect the dimming level by averaging the drive voltage levels. The dimming level signal may be a DC signal having a constant voltage value. For example, for a dimming level of 100%, the dimming level signal may be 2V; for a dimming level of 90%, the dimming level signal may be 1.8V; and for a dimming level of 50%, the dimming level signal may be 1V. The dimming level signal corresponding to the dimming level may be changed using various circuit designs. For example, an resistor-capacitor (RC) integration circuit may be used.

The phase cut reference setting unit 150 has a phase cut reference value. The phase cut reference value may be preset by a user or changed, as needed. That is, the phase cut reference setting unit 150 is determined by a user and the phase cut reference value may be set to an interval in which failure such as flickering occurs or within the shortest driving interval in which all of the first to fourth LED groups 310 to 340 are driven at a low dimming level. For example, the phase cut reference value may be set within an interval in which all of the first to fourth LED groups 310 to 340 are driven.

The LED driving module 200 includes a comparator 160, an LED current blocking unit 170, and the LED group driving units 180.

The comparator 160 is configured to compare the dimming level signal of the dimming level detection unit 140 with the phase cut reference value of the phase cut reference setting unit 150.

The LED current blocking unit 170 is configured to stop driving of the first to fourth LED groups 310 to 340 when the dimming level signal of the dimming level detection unit 140 is lower than the phase cut reference value of the phase cut reference setting unit 150. The LED current blocking unit 170 outputs a stop signal to the LED group driving units 180. Here, the LED current blocking unit 170 may be included in the comparator 160.

The LED group driving units 180 control sequential driving of the first to fourth LED groups 310 to 340 according to the voltage level of the drive voltage input from the rectification unit 120. That is, the AC-driven LED lighting apparatus has first to seventh intervals in which the first to fourth LED groups 310 to 340 are sequentially driven. The first interval is defined as an interval in which the voltage level of the drive voltage input from the rectification unit 120 is a value between a first forward voltage level and a second forward voltage level, and, in the first interval, only a first current path $P_1$ is connected to turn on the first LED group 310 to emit light. In addition, the second is defined as an interval in which the voltage level of the drive voltage input from the rectification unit 120 is a value between the second forward voltage level and a third forward voltage level, and, in the second interval, the second current path $P_2$ is connected to turn on the first and second LED groups 310, 320 to emit light. Further, the third interval is defined as an interval in which the voltage level of the drive voltage input from the rectification unit 120 is a value between the third forward voltage level and a fourth forward voltage level, and, in the third interval, a third current path $P_3$ is connected to turn on the first to third LED groups 310 to 330 to emit light. Further, the fourth interval is defined as an interval in which the voltage level of the drive voltage input from the rectification unit 120 is the fourth forward voltage level, and, in the fourth interval, a fourth current path $P_4$ is connected to turn on the first to fourth LED groups 310 to 340 to emit light. Further, the fifth interval is defined as an interval in which the voltage level of the drive voltage input from the rectification unit 120 is a value between the fourth forward voltage level and the third forward voltage level, and, in the fifth interval, the third current path P3 is connected to turn on the first to third LED groups 310 to 330 to emit light. Further, the sixth interval is defined as an interval in which the voltage level of the drive voltage input from the rectification unit 120 is a value between the third forward voltage level and the second forward voltage level, and, in the sixth interval, the second current path P2 is connected to turn on the first and second LED groups 310, 320 to emit light. Further, the seventh interval is defined as an interval in which the voltage level of the drive voltage input from the rectification unit 120 is a value between the second forward voltage level and the first forward voltage level, and, in the seventh interval, only the first current path $P_1$ is connected to turn on the first LED group 310 to emit light. The first and seventh intervals may be defined as a first stage driving interval, the second and sixth intervals may be defined as a second stage driving interval, the third and fifth intervals may be defined as a third stage driving interval, and the fourth interval may be defined as a fourth stage driving interval.

Although not shown in the drawings, the LED driving module 200 further includes a drive current controller (not shown) configured to control the magnitude of a drive current for the first to fourth LED groups 310 to 340 corresponding to a dimming level. The drive current controller may be included in the LED group driving units 180. The drive current controller may be set to be proportional to the dimming level. The drive current controller may include a drive current resistor preset corresponding to the dimming level.

Referring to FIG. 1 and FIG. 2, in the driving method of the AC-driven LED lighting apparatus according to this exemplary embodiment, a phase cut AC voltage corresponding to a dimming level selected by a user is generated by the TRIAC dimmer 100 (S100).

The rectification unit 120 generates a drive voltage by rectifying the phase cut AC voltage and outputs the drive voltage (S200).

The dimming level detection unit 140 detects a current dimming level selected by a user based on the drive voltage supplied from the rectification unit 120 and outputs a dimming level signal corresponding to the detected dimming level to the LED driving module 200 (S300).

The LED driving module 200 compares the dimming level signal with a phase cut reference value (S400). The LED driving module 200 includes the comparator 160 configured to compare the dimming level signal with the phase cut reference value and the LED current blocking unit 170 configured to stop driving of all of the first to fourth LED groups 310 to 340 when the dimming level is less than a preset phase cut reference value.

If the dimming level signal is higher than or equal to the phase cut reference value, the LED driving module 200 supplies a drive current corresponding to the dimming level to one of the first to fourth LED groups 310 to 340 (S500). Here, the comparator 160 compares the dimming level signal with the phase cut reference value during a driving interval of the first to third LED groups 310 to 340.

If the dimming level signal is less than the phase cut reference value, the LED driving module 200 blocks the drive current supplied to the first to fourth LED groups 310 to 340 (S600). Here, the comparator 160 compares the dimming level signal with the phase cut reference value during an interval in which driving of the first to third LED groups 310 to 340 is stopped. Accordingly, the LED driving module 200 according to this exemplary embodiment can control driving of the first to third LED groups 310 to 340 corresponding to the dimming level changing over time by comparing the dimming level signal with the phase cut reference value during the driving interval of the first to third LED groups 310 to 340 and the driving stop interval thereof.

According to the exemplary embodiment, when the dimming level is less than the preset phase cut reference value, the AC-driven LED lighting apparatus blocks the drive current from being supplied to all of the first to fourth LED groups 310 to 340, thereby preventing uneven brightness such as flickering. Particularly, the AC-driven LED lighting apparatus can improve flickering and uneven dimming occurring upon change from the maximum driving interval to other intervals, in which LED groups are turned off one by one (the fourth stage driving interval and the third stage driving interval with reference to the maximum fourth stage driving interval) in a plurality of LED groups configured to be sequentially driven.

Further, the AC-driven LED lighting apparatus according to the exemplary embodiment blocks the drive current from being supplied to all of the first to fourth LED groups 310 to 340 with reference to a preset phase cut reference value, thereby improving compatibility of a dimmer through improvement in dimming characteristics that vary depending upon the TRIAC dimmer 100.

Figure 3:
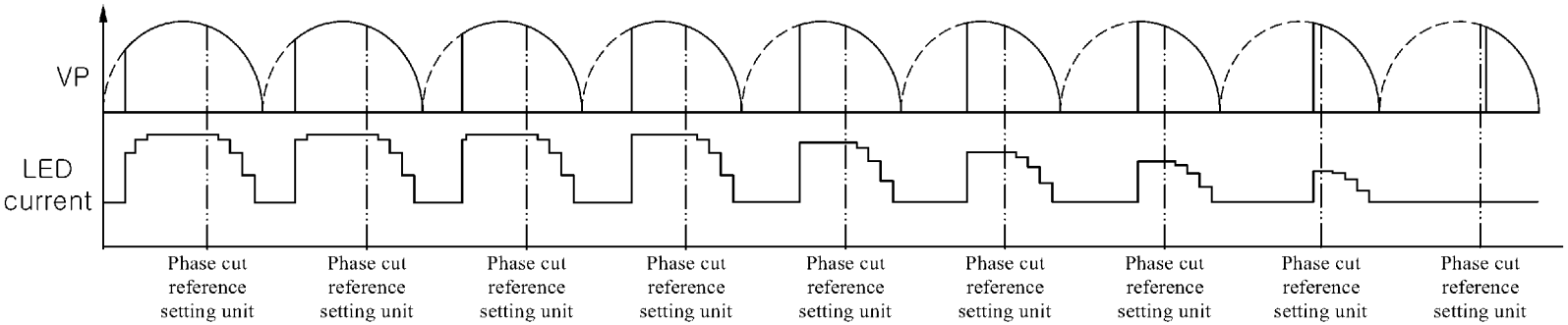
FIG. 3 and FIG. 4 are waveform graphs depicting a relationship between drive voltage and drive current of LEDs depending upon a dimming level.
Figure 4:
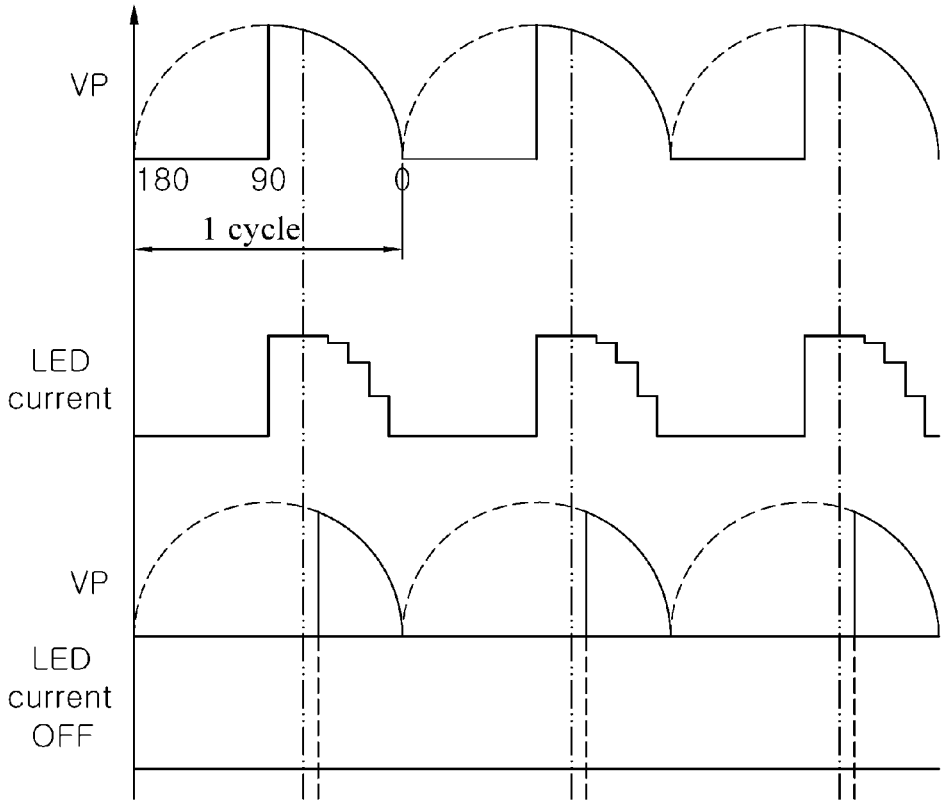

FIG. 3 and FIG. 4 are waveform graphs depicting a relationship between drive voltage and drive current of LEDs depending upon a dimming level.

As shown in FIG. 3 and FIG. 4, the AC-driven LED lighting apparatus according to exemplary embodiments exhibits smooth dimming characteristics over an entire interval of a dimming level by controlling the magnitude of drive current in proportion to a dimming level selected by a user. In addition, the AC-driven LED lighting apparatus according to the exemplary embodiment blocks drive current from being supplied to all of the LED groups at a dimming level less than a preset phase cut reference value, thereby preventing flickering or uneven dimming. For example, the AC-driven LED lighting apparatus according to the exemplary embodiments stops driving of all of the plural LED groups in an interval in which the dimming level is less than the preset phase cut reference value (in an interval in which the dimming level is gradually decreased from a dimming level of the fourth stage driving interval), thereby preventing flickering or uneven dimming. Here, the phase cut reference value may be set to a value between 90 to 0 with reference to one cycle of a phase-cut AC voltage.

Further, the AC-driven LED lighting apparatus according to the exemplary embodiments can improve compatibility of a dimmer by improving dimming characteristics that vary depending upon the TRIAC dimmer 100.

Although some exemplary embodiments have been described herein, it should be understood that these embodiments are given by way of illustration only and that individual structures, elements or features of a particular embodiment are not limited to that particular embodiment and can be applied to other embodiments without departing from the spirit and scope of the present disclosure.

The invention claimed is:

1. An alternating current (AC)-driven light emitting diode (LED) lighting apparatus, comprising:

a triode for alternating current (TRIAC) dimmer to generate a phase cut AC voltage through phase modulation of an AC voltage corresponding to a selected dimming level;

a rectification circuit to generate a drive voltage through full-wave rectification of the phase cut AC voltage supplied from the TRIAC dimmer;

a dimming level detector to detect a dimming level corresponding to the drive voltage;

a phase cut reference setting unit setting a phase cut reference value for comparison with the detected dimming level; and an LED driving module controlling a plurality of LED groups with constant current by comparing the detected dimming level with the phase cut reference value, wherein the LED driving module comprises an LED current blocking unit configured to block a drive current from being supplied to the plurality of LED groups when the dimming level is less than the phase cut reference value.

2. The AC-driven LED lighting apparatus according to claim 1, wherein the plurality of LED groups is sequentially driven from a first stage driving interval to an $n^{th}$ stage driving interval.

3. The AC-driven LED lighting apparatus according to claim 2, wherein the phase cut reference value is set within the $n^{th}$ stage driving interval in which all of the LED groups are driven.

4. The AC-driven LED lighting apparatus according to claim 1, wherein the LED current blocking unit simultaneously blocks the drive current from being supplied to all of the LED groups.

5. The AC-driven LED lighting apparatus according to claim 1, wherein the LED driving module further comprises a comparator configured to compare the detected dimming level with the phase cut reference value.

6. The AC-driven LED lighting apparatus according to claim 1, wherein LED driving module further comprises a drive current controller configured to control magnitude of the drive current of the plurality of LED groups corresponding to the dimming level.

7. The AC-driven LED lighting apparatus according to claim 6, wherein the drive current controller comprises a drive current register preset to be proportional to the dimming level.

8. The AC-driven LED lighting apparatus according to claim 1, further comprising:

a trigger current holding circuit connected between the TRIAC dimmer and the rectification circuit and supplying a TRIAC trigger current to an AC power input or a rectified voltage output, or acting as a dummy load circuit.

9. The AC-driven LED lighting apparatus according to claim 8, wherein the trigger current holding circuit is a bleeder circuit.

* * * * *